US012377517B2

(12) United States Patent
Chou et al.

(10) Patent No.: US 12,377,517 B2
(45) Date of Patent: Aug. 5, 2025

(54) SANDER WITH ANGULAR ADJUSTABILITY

(71) Applicant: THE KINGCRAFT MACHINERY COMPANY LIMITED, Taichung (TW)

(72) Inventors: Calvin Chou, Taichung (TW); Ming-Ta Chou, Taichung (TW)

(73) Assignee: THE KINGCRAFT MACHINERY COMPANY LIMITED, Taichung (TW)

( * ) Notice: Subject to any disclaimer, the term of this patent is extended or adjusted under 35 U.S.C. 154(b) by 570 days.

(21) Appl. No.: 17/858,807

(22) Filed: Jul. 6, 2022

(65) Prior Publication Data

US 2024/0009800 A1 Jan. 11, 2024

(51) Int. Cl.
*B24B 41/04* (2006.01)
*B24B 9/18* (2006.01)

(52) U.S. Cl.
CPC ..... *B24B 41/04* (2013.01); *B24B 9/18* (2013.01)

(58) Field of Classification Search
CPC ..... B27C 5/02; B24B 27/00; B24B 27/0046; B24B 27/0084; B24B 7/07; B24B 7/075
USPC ..... 144/135.2, 253.2; 83/471.3, 468.3
See application file for complete search history.

(56) References Cited

U.S. PATENT DOCUMENTS 1,277,377 A * 9/1918 Carter ..... B24B 47/16 451/340
2,127,071 A * 8/1938 Schmalz ..... B24B 27/0084 451/340
2,244,813 A * 6/1941 Tommerup ..... B24B 27/00 451/154
2,435,320 A * 2/1948 Metzger ..... B24B 13/02 451/277
4,555,229 A * 11/1985 Biadigo ..... B28B 11/18 425/459
4,821,457 A * 4/1989 Ianuzzi ..... B24B 27/0084 451/155
5,193,312 A * 3/1993 Gudmundsson ..... B24B 27/04 451/271
5,335,560 A * 8/1994 Wang ..... B24B 27/00 451/155
2009/0280733 A1 11/2009 Wang

* cited by examiner

*Primary Examiner* — Joel D Crandall
(74) *Attorney, Agent, or Firm* — MUNCY, GEISSLER, OLDS & LOWE, P.C.

(57) ABSTRACT

A sander with angular adjustability includes a main body, a workbench, a grinding shaft, a driver, and an angle-adjusting device. The workbench is mounted on a top of the main body. The grinding shaft is rotatably installed on the main body and exposed outside the workbench. The driver is installed in the main body, for driving the grinding shaft to rotate. The angle-adjusting device is configured to be in transmissive connection with the driver. The angle-adjusting device is configured to be switched and operate between a locked position and a released position. In the released position, the grinding shaft has its grinding angle adjustable with respect to the workbench, and in the locked position, the grinding shaft is held at a grinding position by the angle-adjusting device. Thereby, operation of the sander is angularly adjustable to fit different wooden workpieces.

15 Claims, 8 Drawing Sheets

SANDER WITH ANGULAR ADJUSTABILITY

BACKGROUND OF THE INVENTION

1. Technical Field

The present invention relates to sanders, and more particularly to a sander with angular adjustability.

2. Description of the Related Art

A sander is a tool for sanding wooden workpieces. For example, US Patent Publication No. US20090280733A1 has disclosed a woodwork grinder, which has a grinding base and a rotating shaft extending out from the grinding base. A grinding sleeve is mounted around the rotating shaft for grinding workpieces. The grinding sleeve is such arranged that it is upstanding with respect to the grinding base. During operation of the woodwork grinder, the grinding sleeve is only allowed to grind workpieces at a fixed angle, and this limits applications of the woodwork grinder.

SUMMARY OF THE INVENTION

To address the foregoing issues, the objective of the present invention is to provide a sander with angular adjustability, which has its grinding shaft angularly adjustable with respect to its workbench, and thereby can sand wooden workpiece at different angles, making the sander more adaptive as compared to the existing devices.

To achieve the foregoing objective, one embodiment of the present invention provides a sander with angular adjustability, which comprises a main body, a workbench, a grinding shaft, a driver, and an angle-adjusting device. The workbench is mounted on a top of the main body. The workbench has an opening communicated with the interior of the main body. The grinding shaft is rotatably installed on the main body exposed at the opening of the workbench. The driver is installed in the main body and in transmissive connection with the grinding shaft for driving the grinding shaft to rotate. The angle-adjusting device is in transmissive connection with the driver, and is configured to be switched and operate between a locked position and a released position. In the released position, the grinding shaft has its grinding angle adjustable with respect to the workbench, and in the locked position, the grinding shaft is held at a grinding position by the angle-adjusting device.

In another embodiment of the present invention, the angle-adjusting device comprises a swaying base, a lever, and a locking switch. The swaying base is such installed in the main body that it is swayable between a first position and a second position. The driver is immovably fixed to the swaying base. The locking switch is installed outside the main body. The lever passes through the locking switch and the main body so that it is in transmissive connection with the swaying base. When the angle-adjusting device is in the released position, the lever is allowed to slide with respect to the locking switch to in turn drive the swaying base to sway. When the angle-adjusting device is in the locked position, the locking switch engages with and prevents the lever from sliding.

In another embodiment of the present invention, the locking switch has a switch seat and an engaging member. The switch seat has a through hole and an acting hole that is intercommunicated with the through hole. The acting hole allows the engaging member to be slidably fit therein. The engaging member has an engaging hole. The engaging hole has a diameter greater than that of the through hole. The lever passes through the engaging hole and the through hole. When the angle-adjusting device is in the locked position, the engaging member engages with the lever. When the angle-adjusting device is in the released position, the lever is allowed to slide with respect to the engaging hole and the through hole.

In another embodiment of the present invention, the locking switch further comprises a returning member arranged between the engaging member and the switch seat so that it resiliently props against the engaging member to make the engaging member normally engage with the lever.

In another embodiment of the present invention, there is further a positioning device arranged between the swaying base and the main body, and configured to selectively position the swaying base between the first position and the second position.

In another embodiment of the present invention, the positioning device comprises two screw members, and the main body has its two opposite laterals each provided with a slide track. Each of the screw members has a threaded section and a propping section. The threaded section passes through the slide track so that it is screwed into the swaying base. When the screw members are screwed to tight, their propping sections prop against the two laterals of the main body.

With the angle-adjusting device, the grinding shaft of the sander can be posed at different angles with respect to the workbench, making operation of the sander angularly adjustable to fit different wooden workpieces.

DETAILED DESCRIPTION OF THE INVENTION

Figure 1:
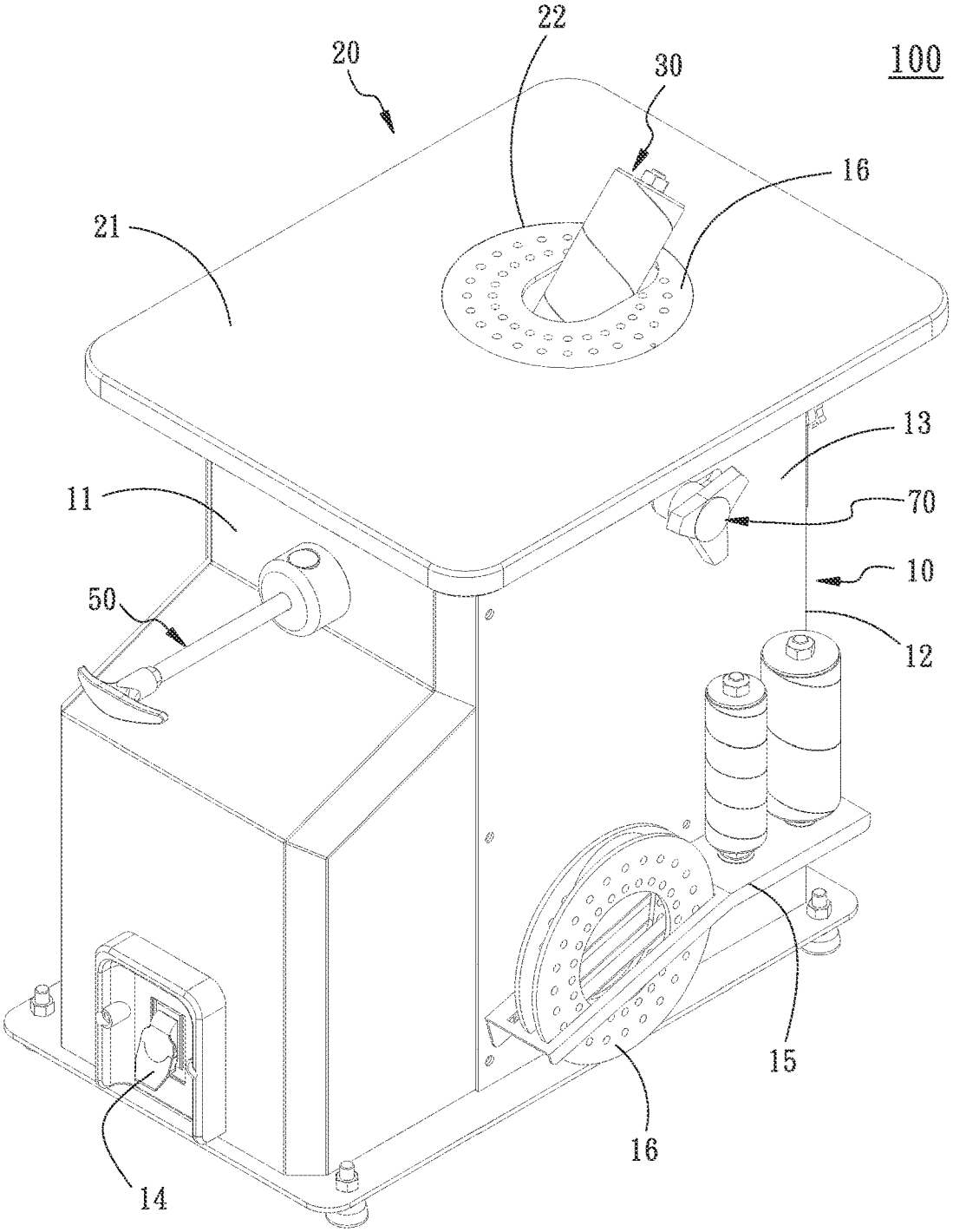
FIG. 1 is a perspective view of a sander with angular adjustability of the present invention.
Figure 2:
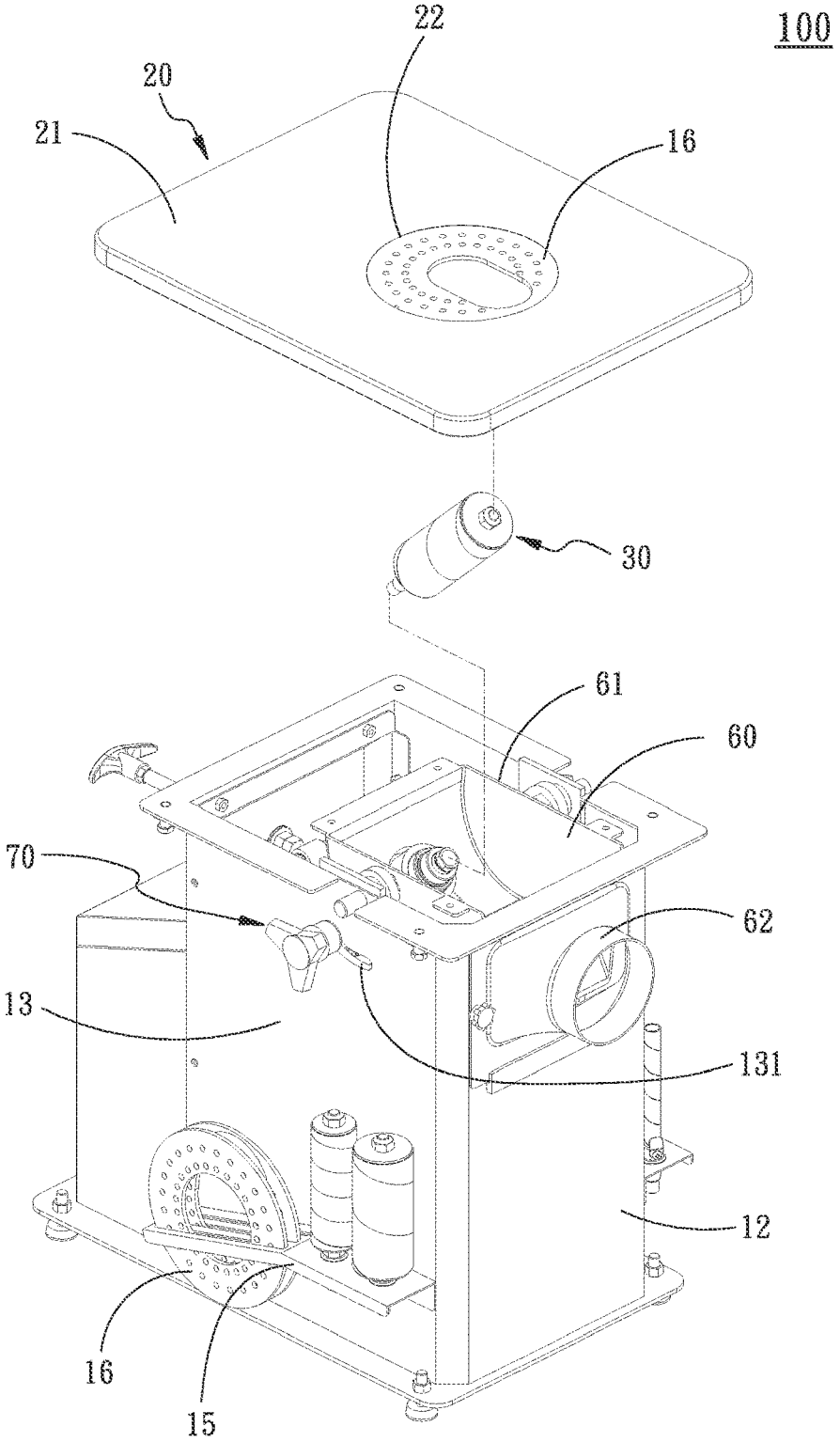
FIG. 2 is similar to FIG. 1, showing the sander with angular adjustability having its workbench detached from its main body.

The following preferred embodiments when read with the accompanying drawings are made to clearly exhibit the above-mentioned and other technical contents, features, and effects of the present invention. However, the accompanying drawings are intended for reference and illustration, but not to limit the present invention and are not made to scale.

Referring to FIG. 1 through FIG. 8, the present invention discloses a sander with angular adjustability 100, which comprises a vertical main body 10, a workbench 20, a grinding shaft 30, a driver 40, and an angle-adjusting device 50. With the angle-adjusting device 50, the grinding shaft 30 can be posed at different angles with respect to the workbench 20, making operation of the sander angularly adjustable to fit different wooden workpieces.

The main body 10 has a front surface 11, a back surface 12, and two laterals 13 between the front surface 11 and the back surface 12. The front surface 11 has a power switch 14 near the bottom of the sander 100 for controlling operation of the sander 100. In the embodiment of the present invention, the two laterals 13 are each provided with a slide track 131. Additionally, the main body 10 has each of its two laterals 13 provided with a shelf 15 for storing grinding shafts 30 of different sizes and dust shields 16 of different models.

Figure 3:
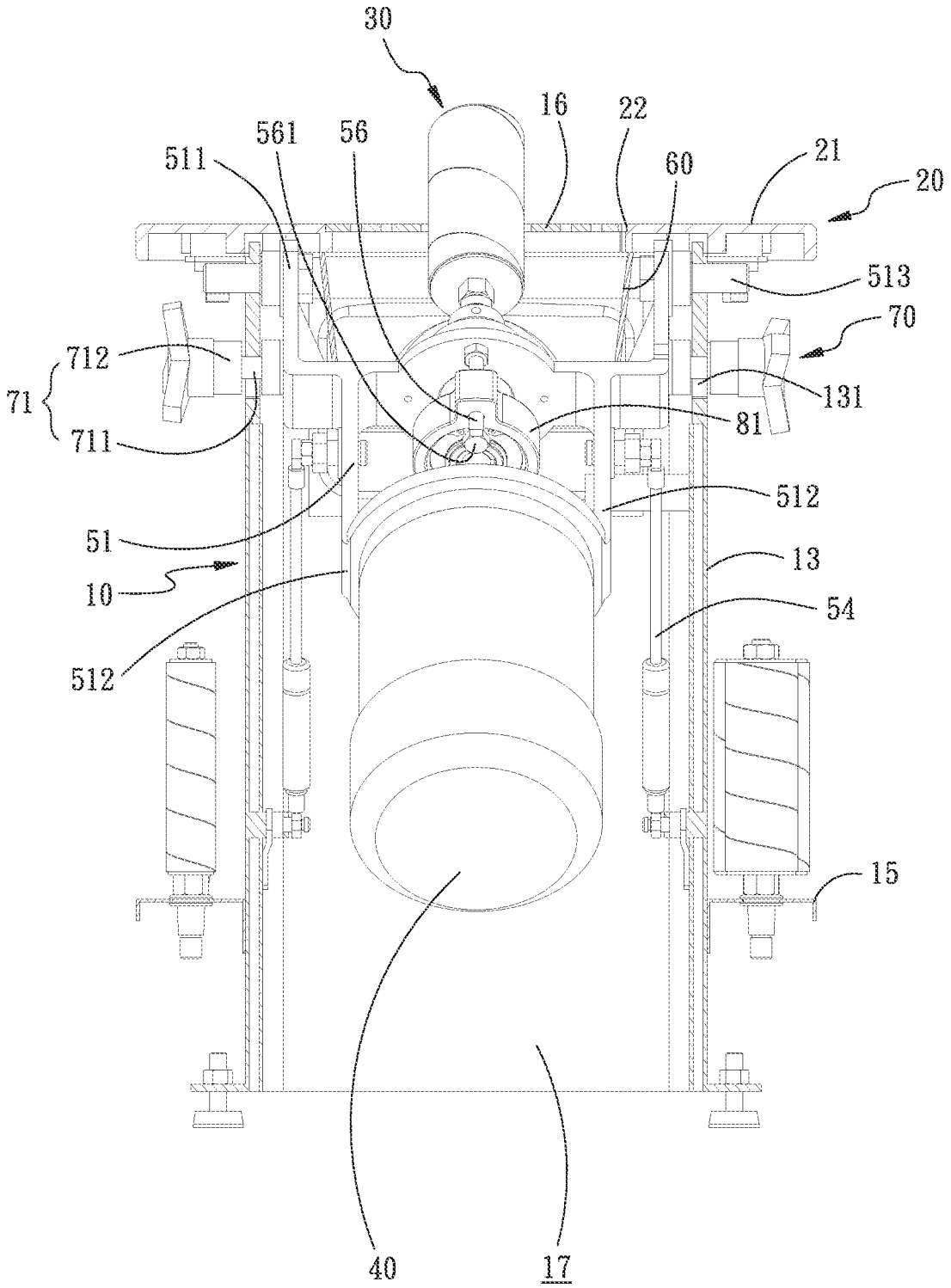
FIG. 3 is a partially cross-sectional view from the front of the sander with angular adjustability, showing the internal structure of the main body.

The workbench 20 is mounted on the top of the main body 10. The workbench 20 has a working surface 21 that is substantially parallel to the ground. The working surface 21 has an opening 22 communicated with an accommodate space 17 defined inside the main body 10 (as shown in FIG. 3). Therein, the workbench 20 is embedded with a perforated dust shield 16 at the opening 22. The dust shield 16 may be replaced as needed.

In another embodiment of the present invention, there is further a dust-collecting box 60 installed below the workbench 20 in the accommodate space 17 of the main body 10. The dust-collecting box 60 has a dust-collecting port 61 and a dust-discharging port 62. The dust-collecting port 61 is aligned and communicated with the opening 22 and the dust shield 16. The dust-discharging port 62 is located at the back surface 12 of the main body 10 and connected to a dust collector (not shown in the figure).

The grinding shaft 30 is rotatably installed on the main body 10 and exposed outside the workbench 20 at the opening 22. The grinding shaft 30 has an axle 31 and an emery cloth 32 wrapping the peripheral surface of the axle 31.

The driver 40 is a motor. The driver 40 is installed in the main body 10 and is in transmissive connection with the grinding shaft 30, so as to drive the grinding shaft 30 to rotate and perform grinding operation. Therein, the driver 40 has a rotating shaft 41.

The angle-adjusting device 50 is in connection with the driver 40 and is configured to be switched and operate between a locked position and a released position. In the released position, the grinding shaft 30 can have its grinding angle adjusted with respect to the workbench 20. In the locked position, the angle-adjusting device 50 holds the grinding shaft 30 at the grinding position.

In the embodiment of the present invention, the angle-adjusting device 50 comprises a swaying base 51, a lever 52, a locking switch 53, a support 54, and a driven component 55. The swaying base 51 is such installed in the main body 10 that it is swayable between a first position and a second position. Therein, the swaying base 51 has a pivoting end 511 and a swinging end 512. The driver 40 is fixed to the swinging end 512. The pivoting end 511 has its two laterals pivotally connected to two inner laterals of the main body 10 each through a pivot 513.

The locking switch 53 is installed outside the main body 10. In the embodiment of the present invention, the locking switch 53 is located at the front 11 of the main body 10 for a user to operate easily. The lever 52 passes through the locking switch 53 and the main body 10 and is in connection with the swaying base 51. In the released position, the lever 52 is allowed to slide with respect to the locking switch 53 when pulled or pushed, so as to make the swaying base 51 sway. In the locked position, the locking switch 53 engages with the lever 52.

Figure 4:
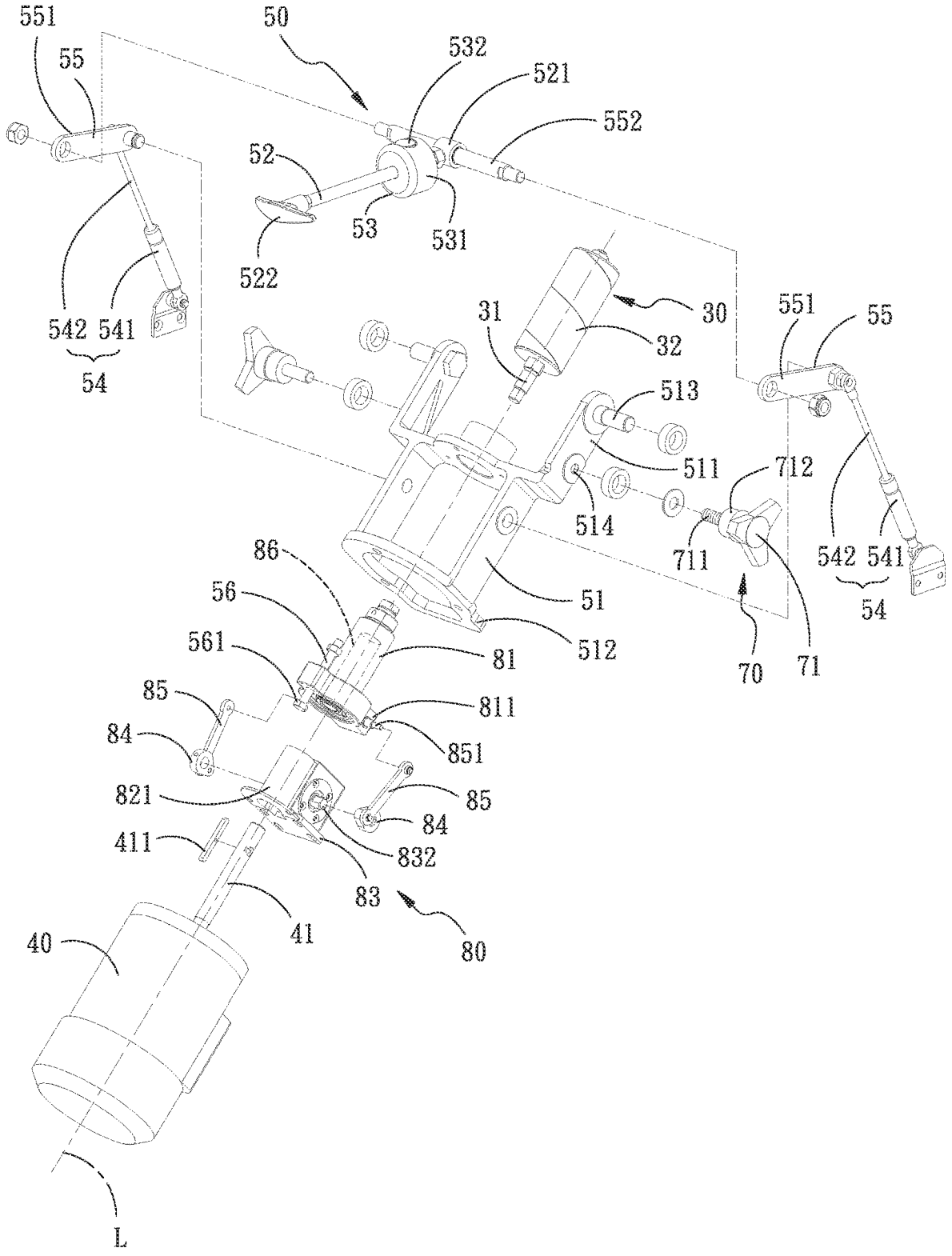
FIG. 4 is an exploded view of the internal structure of the sander with angular adjustability.
Figure 5:
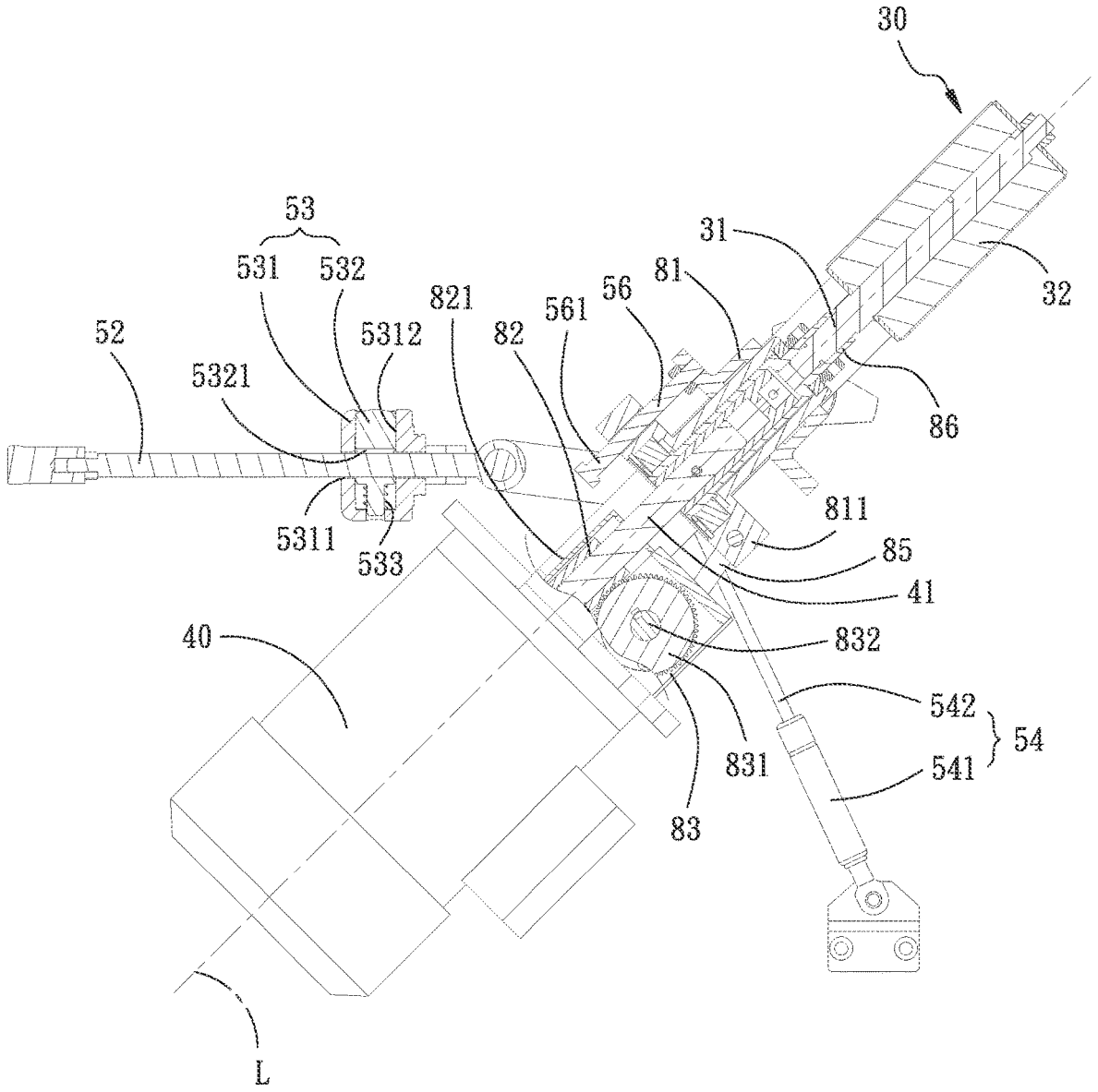
FIG. 5 is a partially cross-sectional view of the internal structure of the sander with angular adjustability.

As shown in FIG. 4 and FIG. 5, in the embodiment of the present invention, the locking switch 53 has a switch seat 531, an engaging member 532, and a returning member 533. The switch seat 531 has a through hole 5311 and an acting hole 5312 that is intercommunicated with the through hole 5311. The acting hole 5312 allows the engaging member 532 to slide therein. The returning member 533 is arranged between the engaging member 532 and the switch seat 531, and resiliently props against the engaging member 532. In other words, the returning member 533 is in the acting hole 5312 to prop against the engaging member 532, so that the engaging member 532 normally engages with the lever 52. The engaging member 532 has an engaging hole 5321. The engaging hole 5321 has a diameter greater than that of the through hole 5311. The lever 52 passes through the engaging hole 5321 and the through hole 5311. Thereby, in the locked position, the engaging member 532 is propped by the returning member 533, and the inner wall of the engaging hole 5321 of the engaging member 532 engages with the lever 52 to prevent the lever 52 from displacement. In the released position, the engaging member 532 can be pushed by a user, so that the engaging member 532 retracts to press on the returning member 533. This makes the part of the engaging hole 5321 that originally props against the lever 52 move downward, so that the lever 52 is allowed to slide with respect to the engaging hole 5321 and the through hole 5311. Then the user can push or pull the lever 52 to drive the swaying base 51 to sway.

The lever 52 has a driven end 521 and an operating end 522. The operating end 522 is exposed outside the main body 10, and the driven end 521 is pivotally connected to one end of the driven component 55. The driven component 55 has its opposite end, together with the support 54, pivotally connected to the swaying base 51. In the embodiment of the present invention, the driven component 55 has two arms 551 located at two laterals of the swaying base 51 and, together with the supports 54, pivotally connected to the two laterals of the swaying base 51, respectively. The driven component 55 further includes a bar 552 connected between the two arms 551. The bar 552 receives the driven end 521 of the lever 52. Herein, two supports 54 are each depicted as a gas cylinder. Every support 54 has a cylinder body 541 fixed to the main body 10 and a shaft 542 that is configured to extend with respect to the cylinder body 541 and is, together with a respective arm 551, pivotally connected to the swaying base 51, so that the supports 54 can support the swaying base 51 at the aforementioned locked position.

In another embodiment of the present invention, there is further a positioning device 70 that is arranged between the swaying base 51 and the main body 10 and is configured to selectively position the swaying base 51 between the first position and the second position. The positioning device 70 has two screw members 71. Each of the screw members 71 has a threaded section 711 and a propping section 712. The threaded section 711 passes through the slide track 131 so that it is screwed into the threaded hole 514 of the swaying base 51. When the screw members 71 are screwed to tight, their propping sections 712 prop against the two laterals 13 of the main body 10, so that the swaying base 51 is positioned at a predetermined grinding angle. When the screw members 71 are unscrewed, the locking switch 53 of the angle-adjusting device 50 can be operated to adjust the grinding angle of the swaying base 51, thereby adjusting the grinding angle of the grinding shaft 30 with respect to the workbench 20.

In another embodiment of the present invention, there is further a lifting device 80 connected between the rotating shaft 41 of the driver 40 and the grinding shaft 30. The lifting device 80, in response to the rotation of the rotating shaft 41, simultaneously transmits the corresponding pushing or pulling force to the grinding shaft 30, so that the grinding shaft 30 can move up and down with respect to the workbench 20 in addition to performing rotation, making operation of grinding wooden workpieces more versatile. Therein, the lifting device 80 comprises a slide seat 81, a worm screw part 82, a gear box 83, a crank 84, a link 85, and a coupling member 86.

The slide seat 81 is connected between the rotating shaft 41 and the grinding shaft 30. In the embodiment of the present invention, the slide seat 81, the rotating shaft 41, and the grinding shaft 30 are arranged along an axis L. The slide seat 81 is installed in the swaying base 51 and has the coupling member 86 so as to be axially connected to the rotating shaft 41 and the grinding shaft 30. The worm screw part 82 is mounted around and rotates with the rotating shaft 41, and has an outer periphery covered by a dustproof sleeve 821. The gear box 83 rotatably accommodates a worm gear 831 and a worm shaft 832. The worm gear 831 engages with one side of the worm screw part 82. The crank 84 is axially connected to the worm shaft 832 of the worm gear 831. The link 85 has its one end connected to the crank 84 and has its opposite end connected to the slide seat 81. Herein, two cranks 84 and two links 85 are depicted. The two links 85 are connected to the slide seat 81 through a link axle 851. In addition, the two cranks 84 and the two links 85 are located at two sides of the worm gear 831, respectively. Therein, the coupling member 86 is installed within the slide seat 81. The rotating shaft 41 is inside the slide seat 81 and axially coupled to the coupling member 86 through a key 411.

Thereby, when the rotating shaft 41 of the driver 40 rotates, it drives the grinding shaft 30 through the coupling member 86. The rotating shaft 41 uses the worm screw part 82 to rotate the worm gear 831, which in turn drives the cranks 84 and the links 85 at its two sides to make the slide seat 81 take the grinding shaft 30 to move to and fro along the axis L, so that the grinding shaft 30 can move up and down with respect to the workbench 20.

In another embodiment of the present invention, the swaying base 51 has a guide 56 parallel to axis L. The guide 56 has its one end connected to the swaying base 51 and has its opposite end passing through one lateral of the slide seat 81. An axle seat 811 is provided at the opposite lateral of the slide seat 81 for the link axle 851 to pass therethrough and get fixed therein. In addition, the guide 56 is terminally provided with a retaining member 561 for preventing the slide seat 81 from coming off the guide 56.

Figure 6:
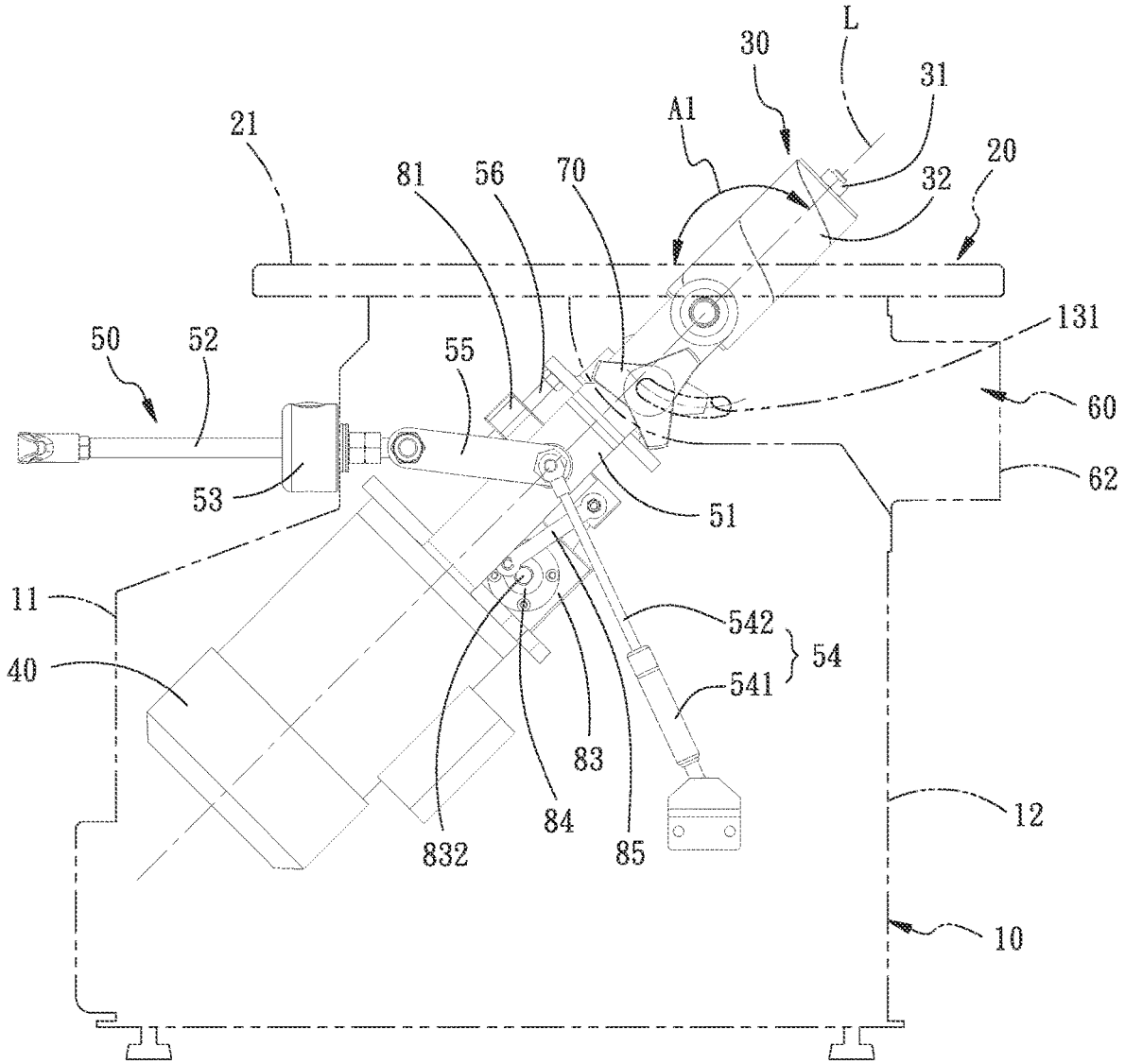
FIG. 6 is a lateral view of the internal structure of the sander with angular adjustability, showing the swaying base in a first position.

Referring to FIG. 6, the angle-adjusting device 50 of the present invention is in the locked position. The locking switch 53 now engages with the lever 52 so that the swaying base 51 is in the first position. Here, the grinding shaft 30 is posed at a first grinding angle A1 with respect to the working surface 21 of the workbench 20.

Figure 7:
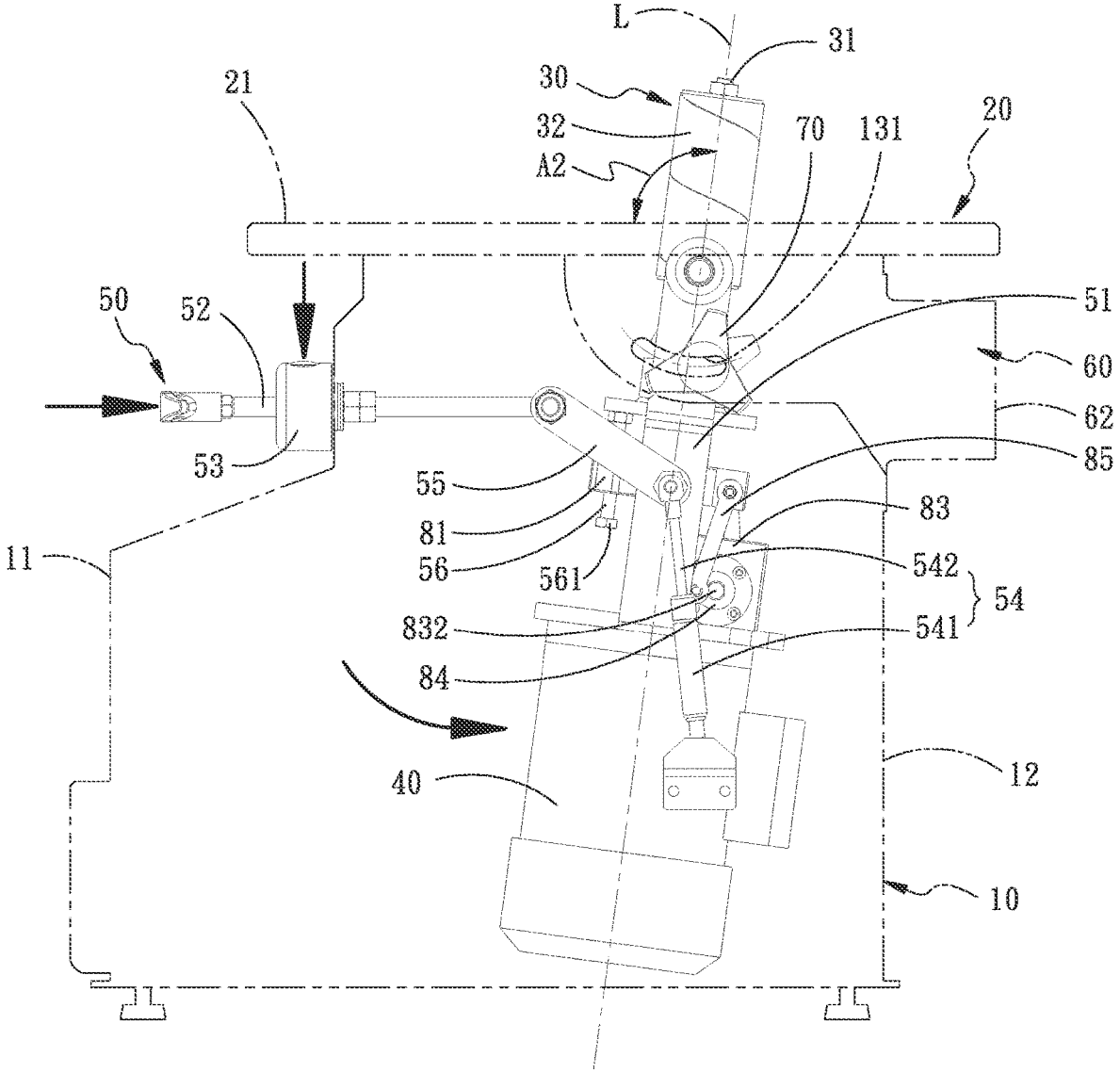
FIG. 7 is another lateral view of the internal structure of the sander with angular adjustability, showing that the locking switch is operated and the lever is moved to position the swaying base in a second position.

Also referring to FIG. 7, to adjust the grinding angle of the grinding shaft 30, the positioning device 70 is released so that a user can push the locking switch 53 to release the lever 52 from engagement. This operation switches the angle-adjusting device 50 to the released position. At this time, the user can push the lever 52 toward the back surface 12 of the main body 10 to make the lever 52 drive the swaying base 51 to sway from the first position to the second position. After the grinding angle of the grinding shaft 30 is such adjusted, the positioning device 70 can be screwed to tight, so as to pose and fix the grinding shaft 30 at the second grinding angle A2 with respect to the working surface 21. Therein, the second grinding angle A2 is smaller than the first grinding angle A1. Through the foregoing operation, a user can adjust the grinding angle of the grinding shaft 30 rapidly according to practical needs so as to adapt the grinding shaft 30 of the sander to wooden workpieces requiring different grinding angles. It is to be noted that since adjustment of the disclosed sander is applied to the grinding angle of the grinding shaft 30, the grinded wooden workpiece remains laid on the working surface 21 horizontally so that a user can easily and stably move the wooden workpiece on the working surface 21 throughout the grinding operation.

Figure 8:
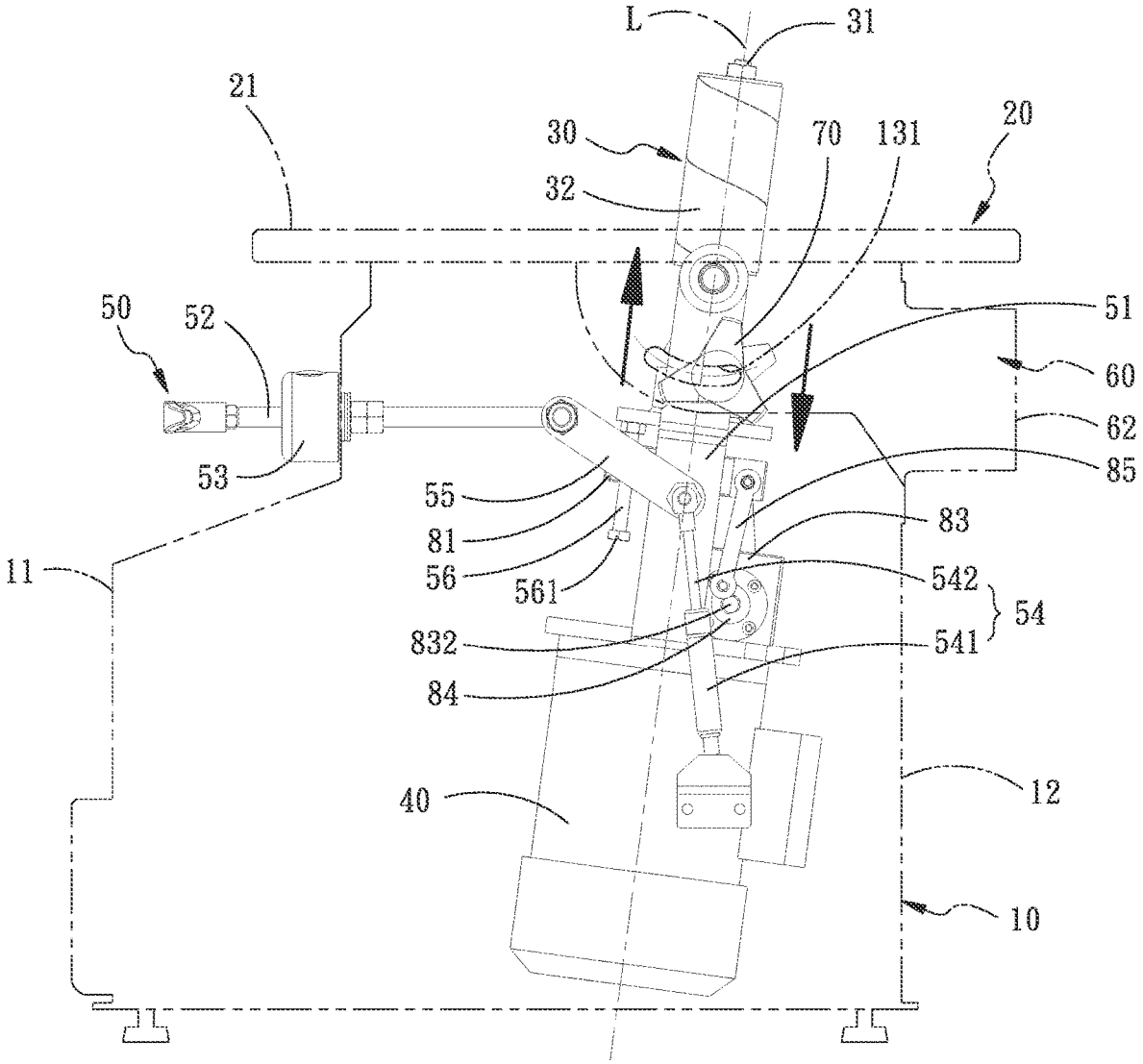
FIG. 8 is a schematic view of the sander with angular adjustability, showing the lifting operation of the grinding shaft.

As shown in FIG. 8, after activated, the driver 40 drives the grinding shaft 30 to rotate while making the slide seat 81 move to and from along the direction of the axis L, thereby making the grinding shaft 30 go up and down with respect to the workbench 20. In this way, during grinding operation, the grinding shaft 30 can not only grind a wooden workpiece laterally, but also axially as the grinding shaft 30 moves up and down, thereby leading to improved grinding efficiency and quality.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A sander with angular adjustability, comprising:

a main body;

a workbench, mounted on a top of the main body and having an opening communicated with an interior of the main body;

a grinding shaft, rotatably installed on the main body and exposed outside the workbench through the opening;

a driver, installed in the main body, and arranged in transmissive connection with the grinding shaft to drive the grinding shaft to rotate; and an angle-adjusting device, arranged in connection with the driver and configured to be switched and operate between a locked position and a released position, whereby when the angle-adjusting device is in the released position, the grinding shaft has a grinding angle thereof adjustable with respect to the workbench, and when the angle-adjusting device is in the locked position, the angle-adjusting device it holds the grinding shaft at a grinding position.

2. The sander with angular adjustability of claim 1, wherein the angle-adjusting device comprises a swaying base, a lever, and a locking switch, the swaying base installed inside the main body that the swaying base is swayable between a first position and a second position, the driver being fixed to the swaying base, the locking switch being installed outside the main body, and the lever passing through the locking switch and the main body so that the lever is in connection with the swaying base, whereby when the angle-adjusting device is in the released position, the lever is allowed to slide with respect to the locking switch when pulled or pushed, so as to make the swaying base sway, and when the angle-adjusting device is in the locked position, the locking switch engages with the lever.

3. The sander with angular adjustability of claim 2, wherein the swaying base has a pivoting end and a swinging end, and the driver is fixed to the swinging end, the pivoting end is pivotally connected to two inner laterals of the main body, and wherein the angle-adjusting device further comprises at least one support and a driven component, in which the lever has a driven end pivotally connected to one end of the driven component and an operating end exposed outside the main body, the other end of the driven component pivotally connected to the swaying base, and the support pivotally connected to the swaying base.

4. The sander with angular adjustability of claim 3, wherein the driven component has two arms and a bar that is connected between the two arms and pivotally receives the driven end of the lever, in which there are two said supports, each of which is, together with a respective said arm, pivotally connected to the swaying base.

5. The sander with angular adjustability of claim 4, wherein each of said two supports is a gas cylinder that has a cylinder body fixed to the main body, and at least one extending shaft configured to extend with respect to the cylinder body, in which the extending shafts of said two supports are, together with the respective arms, pivotally connected to the swaying base.

6. The sander with angular adjustability of claim 2, wherein the locking switch has a switch seat and an engaging member, in which the switch seat has a through hole and an acting hole that is intercommunicated with the through hole, the acting hole allowing the engaging member to slide therein, the engaging member having an engaging hole whose diameter is greater than a diameter of the through hole, and the lever passing through the engaging hole and the through hole, whereby when the angle-adjusting device is in the locked position, the engaging member engages with the lever, and when the angle-adjusting device is in the released position, the lever is allowed to slide with respect to the engaging hole and the through hole.

7. The sander with angular adjustability of claim 6, wherein the locking switch further comprises a returning member that is arranged between the engaging member and the switch seat and resiliently props against the engaging member, so that the engaging member normally engages with the lever.

8. The sander with angular adjustability of claim 2, further comprising a positioning device that is arranged between the swaying base and the main body to selectively position the swaying base between the first position and the second position.

9. The sander with angular adjustability of claim 8, wherein the positioning device has two screw members and the main body has two opposite laterals each provided with a slide track, in which each of the screw members has a propping section and a threaded section that passes through the slide track and is screwed into the swaying base, so that when the screw members are screwed to tight, the propping sections prop against the two laterals of the main body, respectively.

10. The sander with angular adjustability of claim 2, further comprising a lifting device, wherein the driver has a rotating shaft and the lifting device has a slide seat connected between the rotating shaft and the grinding shaft, so that the lifting device, in response to rotation of the rotating shaft, makes the slide seat move to and from along an axis, thereby making the grinding shaft move up and down with respect to the workbench.

11. The sander with angular adjustability of claim 10, wherein the lifting device further comprises a worm screw part, a worm gear, at least one crank, and at least one link, the worm screw part mounted around and rotating with the rotating shaft, the worm gear engaging with the worm screw part, the crank being axially connected to the worm gear, and the link having one end connected to the crank and having an opposite end connected to the slide seat.

12. The sander with angular adjustability of claim 11, wherein there are two said cranks and two said links in the lifting device, in which the two links are connected to the slide seat installed inside the swaying base through a link axle, and the slide seat has a coupling member that is axially connected to the rotating shaft and the grinding shaft.

13. The sander with angular adjustability of claim 11, wherein the swaying base has a guide disposed parallel to the axis, in which the guide has one end connected to the swaying base and an opposite end passing through the slide seat.

14. The sander with angular adjustability of claim 13, wherein the guide is connected to a terminal end of a retaining member for preventing the slide seat from coming off the guide.

15. The sander with angular adjustability of claim 13, further comprising a dust-collecting box, which is installed below the workbench and has a dust-collecting port and a dust-discharging port, wherein the dust-collecting port is aligned and in communication with the opening, and the dust-discharging port is provided at a back surface of the main body.

* * * * *